United States Patent [19]

Arnott et al.

[11] Patent Number: 4,874,099

[45] Date of Patent: Oct. 17, 1989

[54] NAPKIN HOLDER

[75] Inventors: John Arnott; Gary Kaga, both of Toronto, Canada

[73] Assignee: Ontario Limited, Toronto, Canada

[21] Appl. No.: 112,161

[22] Filed: Oct. 26, 1987

[51] Int. Cl.[4] ..... A47F 7/00

[52] U.S. Cl. ..... 211/50; 211/43; 211/184

[58] Field of Search ..... 211/50, 42, 43, 184, 211/11; 108/60, 61; 248/231.4, 316.4; 24/459, 67 R

[56] References Cited

U.S. PATENT DOCUMENTS

| | | | |
|---|---|---|---|
| 945,877 | 1/1910 | Updegraff | 211/43 |
| 1,006,328 | 10/1911 | Widenhoffer | 211/43 |
| 1,682,060 | 8/1928 | Banks | 211/42 X |
| 1,750,576 | 3/1930 | Cubberley | 211/43 X |
| 2,294,595 | 9/1942 | Dice | 211/43 |

*Primary Examiner*—Sarah A. Lechok

*Attorney, Agent, or Firm*—Rogers, Bereskin & Parr

[57] ABSTRACT

An adjustable holder for napkins and the "like" has first and second opposed interlocking slideable end units. Each of the end units has a support panel and a base. The base of the first opposed end unit comprises a longitudinally extending tongue that has a surface with a plurality of transverse ridges. The base of the second opposed end unit has a slot that is adapted to receive the tongue of the other end unit. This slot has a surface which has a plurality of transverse ridges that co-operate with the transverse ridges on the tongue of the first opposed end unit to maintain each end unit in a fixed position respective to the other.

16 Claims, 3 Drawing Sheets

NAPKIN HOLDER

This invention relates to an adjustable holder for napkins and the like. More specifically it pertains to an adjustable holder for napkins and the like, the storage area of which is substantially open.

It is common in the field of book holders and file holders to construct a holder comprising two opposed end units. Such end units comprise a support panel and a horizontal base that forms a right angle with the support panel. The end units are positioned so that they extend towards each other. The books and files are placed in the storage area which is formed between the opposed end units.

There have been different variations of book holders and file holders which have been employed in the past. However, these have all had some disadvantages which make them unsuitable for use as an adjustable holder for napkins and the like. One disadvantage of some of those holders is that while they are adjustable, the end units themselves did not contain a locking means which would maintain the position of the end units relative to each other. Thus, the end units would separate when an external force was applied to the support panels.

Another disadvantage of some of those holders is that in order to adjust the separation distance of the support panels, and thus to change the size of the storage area, it was first necessary to remove the contents from the storage area.

Another disadvantage of those holders is that the end units could not be securely connected together so as to allow the holder and its contents to be easily moved as a whole unit.

Another disadvantage was that the minimum separation distance between the support panels, and thus the minimum size of the storage area, tended to be relatively large.

It has been found that these problems can be overcome by using a napkin holder that comprises first and second opposed interlocking slideable end units, each of which has a support panel and a longitudinally extending base. The base of the first end unit comprises a tongue that has first and second substantially planar opposed surfaces. The base of the second end unit comprises a complementary slot that has a longitudinally extending surface. The longitudinally extending surface and the first opposed surface together comprise interacting detent means.

The invention also relates to an adjustable holder comprising first and second interlocking slideable end units, each of which has a support panel and a longitudinally extending base. The base of the first end unit comprises a tongue that has proximal and distal ends. The tongue also has first and second opposed surfaces that are substantially planar. The first opposed surface has a plurality of transverse ridges which extend over a substantial portion of the longitudinal length of the first opposed surface. The second opposed surface has two relieved surfaces which are located adjacent the distal end of the tongue, one being disposed at each edge of said tongue. The relieved surfaces commence at the distal end of the tongue and extend in the longitudinal direction towards the proximal end of the tongue. The base of the second end unit comprises a generally T shaped slot. The slot has a longitudinally extending surface which has a plurality of transverse ridges that interact with the transverse ridges of the first opposed surface. The tongue and the slot are dimensioned so as to maintain contact between the first opposed surface and the longitudinally extending surface.

The substance and advantages of the invention may be more completely and fully understood by means of the following description of the accompanying drawings of a preferred embodiment of the holder which is the subject of this invention in which.

Figure 1:
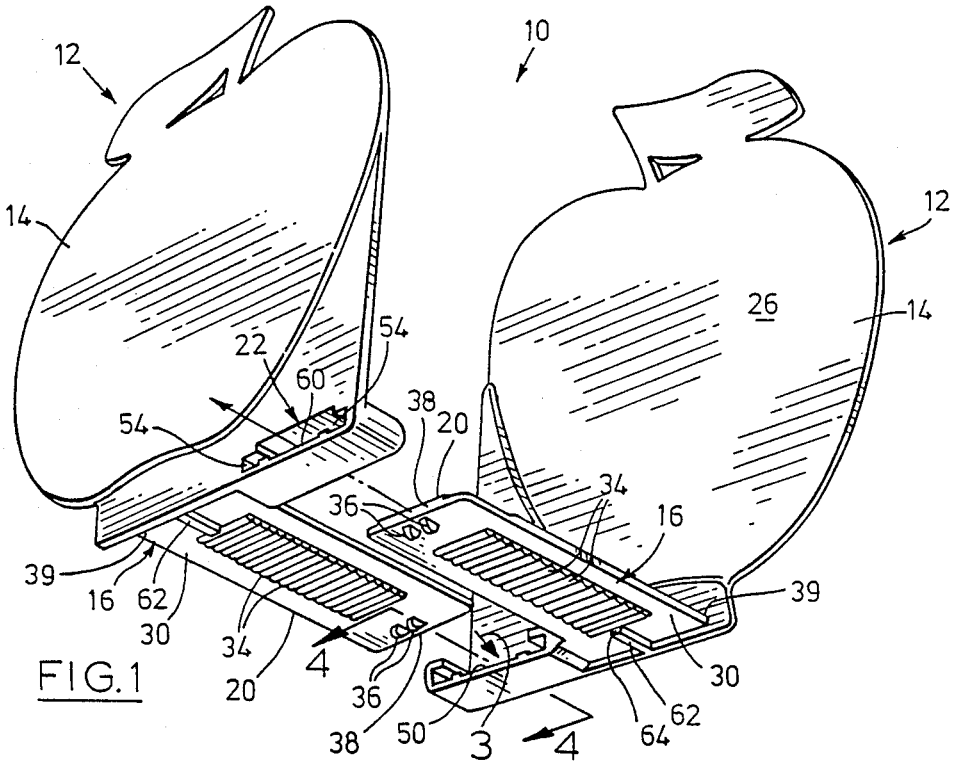
FIG. 1 is a perspective view from below of a preferred embodiment of the holder prior to the engagement of the end units.
Figure 5:
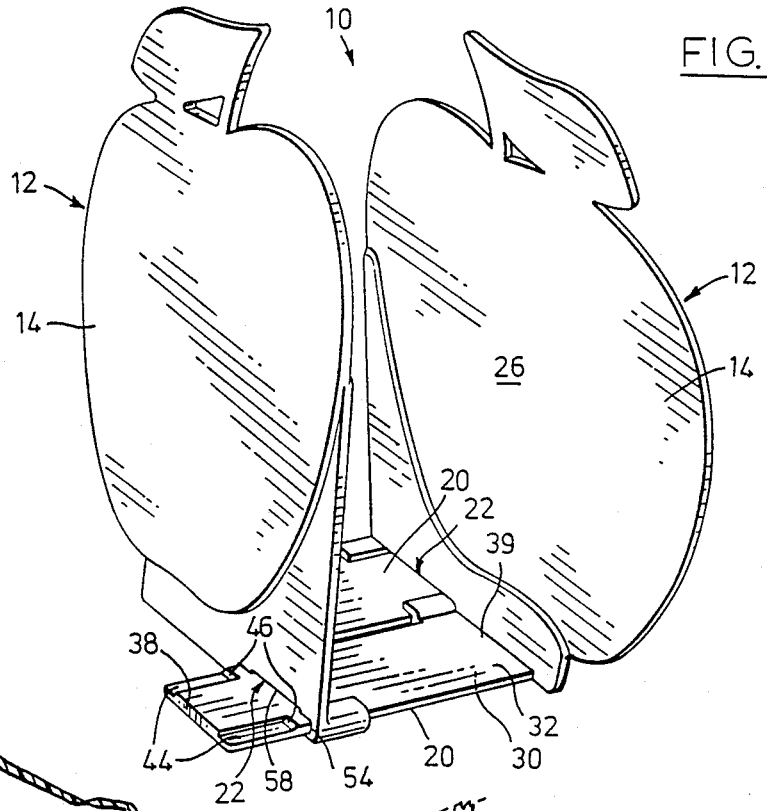
Figure 4A:
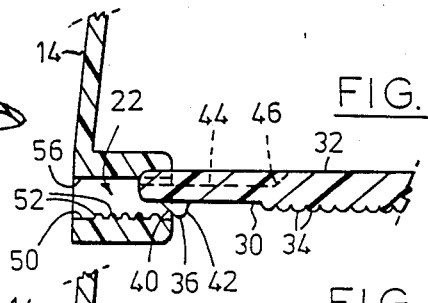
Figure 4B:
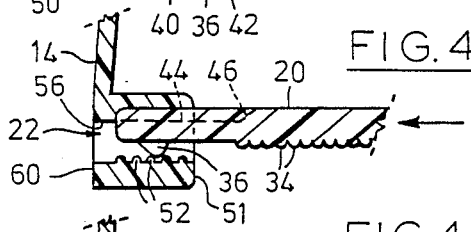
Figure 4C:
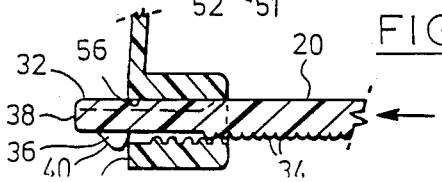

FIGS. 4*a*, 4*b* and 4*c* are cross-section views along line 4—4 in FIG. 1 showing the interaction of a tongue of one end unit with the slot of the other;

FIG. 5 is a perspective view of the holder of FIG. 1.

Figure 7:
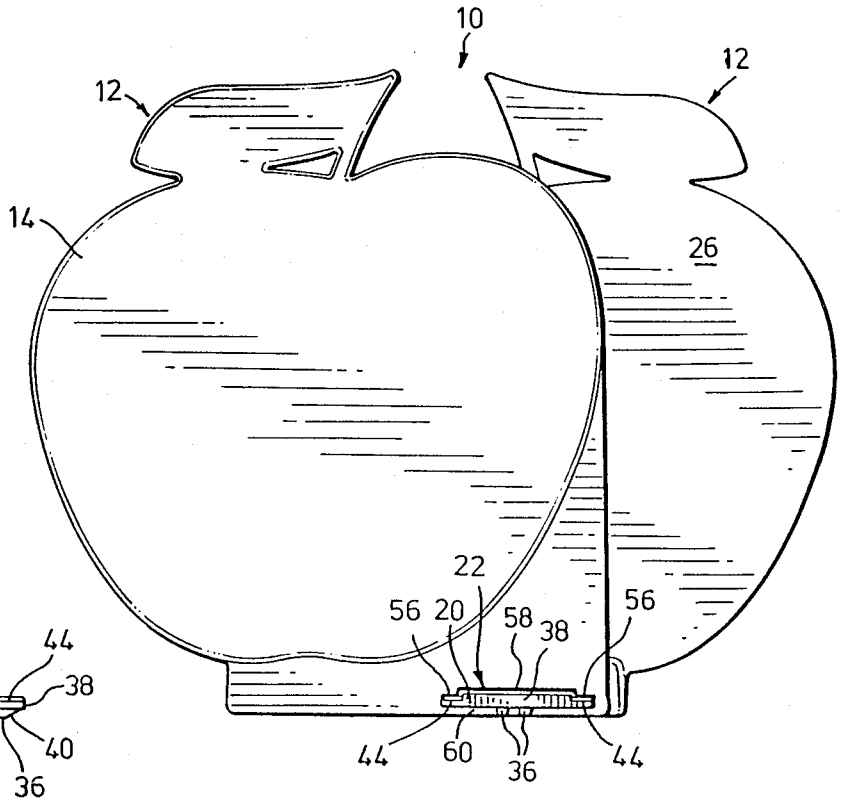
Figure 6:
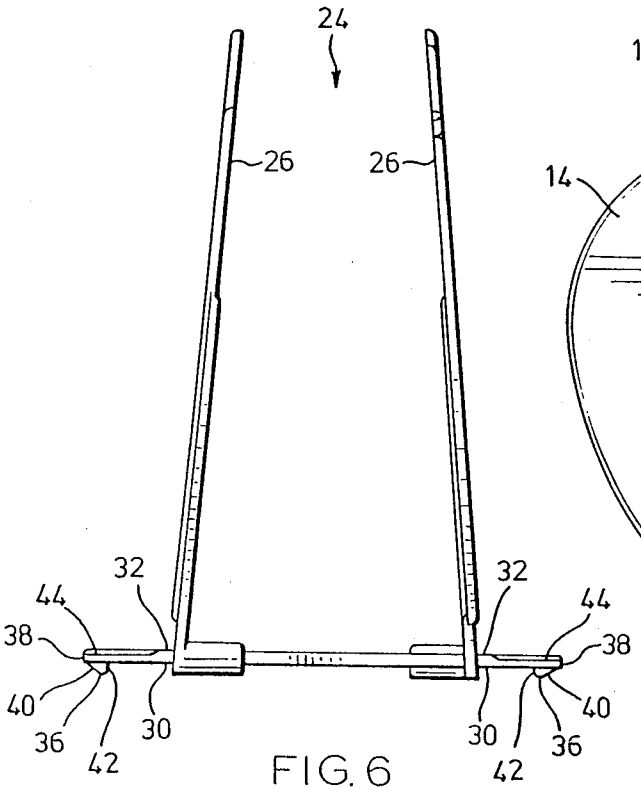

FIG. 6 is a side view of the holder of FIG. 1, and,

FIG. 7 is an end view of the holder of FIG. 1.

Figure 2:
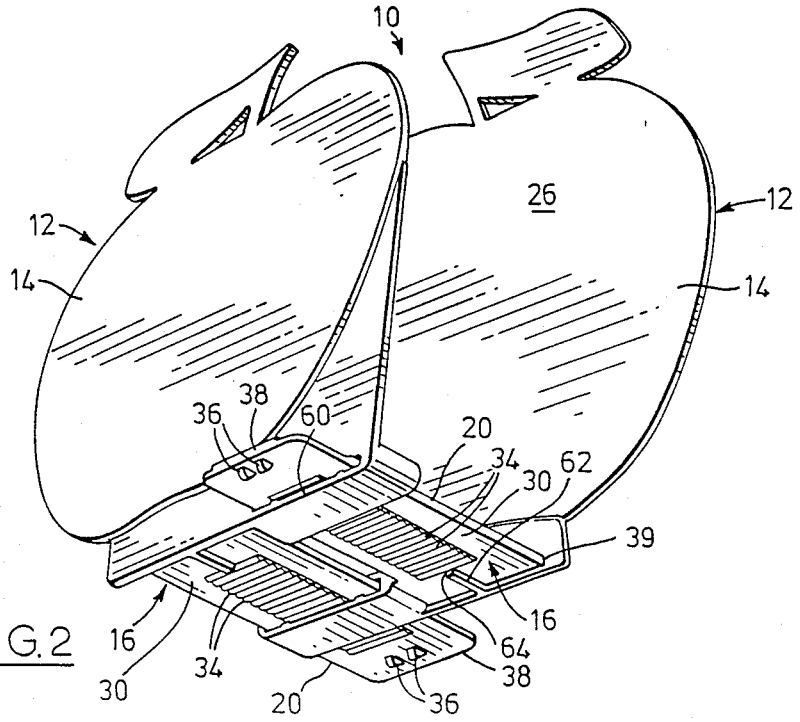
FIG. 2 is a perspective view from below of the holder of FIG. 1 showing the engagment of the end units.

As shown in FIGS. 1 and 2, adjustable holder 10 is composed of two identical end units 12. Each end unit 12 is composed of a support panel 14 and a base 16.

Base 16 is composed of a tongue 20 and a complimentary slot 22. Tongue 20 extends outwardly away from support panel 14 in the longitudinal direction. Slot 22 is generally T shaped and also extends away from support panel 14 in the longitudinal direction. The two end units 12 are positioned in an opposed orientation wherein tongue 20 of each end unit 12 is aligned with slot 22 of the other end unit 12. Storage area 24 is located between support panels 14 of end units 12. The end walls of storage area 24 in the longitudinal direction are comprised of inner surfaces 26 of support panels 14. As tongue 20 passes through slot 22, support panels 14 approach each other, thus decreasing the size of storage area 24.

The napkins are placed in storage area 24 so that the flat surfaces of the outside napkins are substantially parallel to the inner surfaces 26 of support panels 14 (see FIG. 6). Both inner surfaces 26 are substantially planar in shape. When the napkins are placed in storage area 24, end units 12 are pushed towards each other until inner surfaces 26 of support panels 14 are in contact with the napkins. The lateral pressure exerted against the napkins by support panels 14 through inner surfaces 26 securely holds the napkins in place. In the drawings, support panels 14 are shaped in the profile of an apple. However, support panels 14 may be formed in any shape as long as inner surface 26 contacts a substantial part of the surface area of the outside napkins.

Tongue 20 comprises first and second opposed surfaces 30, 32. The opposed surfaces 30 and 32 are substantially planar. First opposed surface 30 has formed thereon a plurality of transverse ridges 34. Transverse ridges 34 extend over a substantial portion of tongue 20 (see FIG. 1). The end of tongue 20 which is furthest from support panel 14 is referred to herein as the distal end 38. Similarly, the end of tongue 20 which is closest to support panel 14 is referred to herein as the proximal end 39. As shown in FIG. 1, two stops 36 are provided on first opposed surface 30 adjacent distal end 38 of tongue 20. Stops 36 are located adjacent the central portion of first opposed surface 30. As shown in FIGS. 4 and 6, each of stops 36 has a surface 40 which is inclined towards distal end 38 so as to meet first opposed surface 30. Each of stops 36 also has a surface 42 which depends substantially perpendicularly from first opposed surface 30.

As shown in FIG. 5, second opposed surface 32 includes two relieved planar surfaces 44. Surfaces 44 are located on tongue 20 at opposite edges of the tongue 20 and extend longitudinally from distal end 38 toward support panel 14. Surfaces 44 are relatively narrow. Inclined surfaces 46 are provided at the ends of surfaces 44 which are nearest proximal end 39. Surfaces 46 are inclined upwards from surfaces 44 towards support panel 14 to meet second opposed surface 32.

Figure 3:
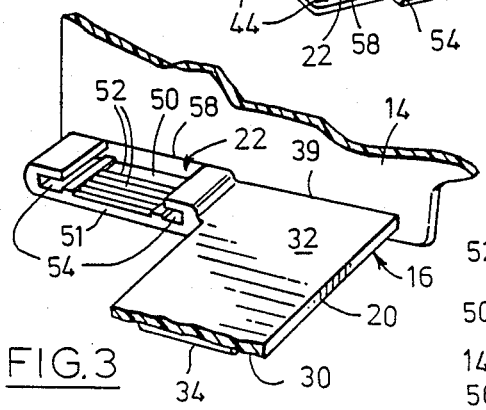
FIG. 3 is a cut away enlargement of the holder of FIG. 1, showing the base of the holder near the support panel.

As shown in FIG. 3, slot 22 has a surface 50 that extends outwardly from support panel 14 for a distance that is substantially equal to the length of surfaces 44 from distal end 38 to inclined surface 46. The edge of surface 50 which is furthest from support panel 14 is referred to herein as edge 51. Surface 50 has a sufficient longitudinal extent so that it contains a plurality of transverse ridges 52. Transverse ridges 34 of the tongue 20 and transverse ridges 52 of the slot 22 may be of any shape which interact to form a detent means. In the preferred embodiment, transverse ridges 34 and 52 are in the shape of transversely extending serrations.

As shown in FIG. 3, slot 22 also has two guide channels 54 that are provided at opposite sides of surface 50. Guide channels 54 are formed integrally with surface 50 and have an upper surface 56 that has a length in said longitudinal direction that is substantially equal to the length of surfaces 44. The height of guide channels 54 from surface 50 to upper surface 56 is substantially equal to the perpendicular distance between first and second opposed surfaces 30, 32 of tongue 20. Slot 22 has an upper wall 58 (FIG. 7) which is oriented to face surface 50. Upper wall 58 has a central portion which is recessed. Outside edge 60 depends substantially perpendicularly from surface 50 of slot 22.

First opposed surface 30 is also provided with longitudinally extending projection 62 (see FIG. 1). Projection 62, which is located substantially centrally on first opposed surface 30, extends from proximal end 39 to a point near transverse ridges 34 where end 64 is located. End 64 abuts end 51 of slot 22 when support panels 14 are at their minimum approach distance.

In order to ensure that end units 12 are locked in position relative to each other when tongue 20 has entered slot 22, it is important that slot 22 is shaped so that transverse ridges 34 of tongue 20 interact with transverse ridges 52 of of slot 22. To achieve this result, slot 22 and tongue 20 are dimensioned so that first opposed surface 30 and longitudinally extending surface 50 are in contact. Thus, there is a section of upper wall 58 of slot 22 where the perpendicular distance from that section to surface 50 is substantially equal to the perpendicular distance between first and second opposed surfaces 30 and 32. In the preferred embodiment, this coincides with upper surface 56 of guide channels 54.

The addition of stops 36 to first opposed surface 30 effectively increases the perpendicular thickness of tongue 20. To counteract this effect part of second opposed surface 32 may be relieved and a part of upper wall 58 may be recessed. The portion of second opposed surface 32 which is relieved is that portion which is aligned with the section of upper wall 58 where the perpendicular distance from that section to surface 50 is substantially equal to the perpendicular distance between first and second opposed surfaces 30 and 32. The rest of upper wall 58 is recessed by an amount that is substantially equal to the perpendicular distance between the relieved surfaces and the plane of second opposed surface 32. The amount by whch second opposed surface 32 is relieved, and consequently the amount by which upper wall 58 is recessed, is approximately equal to the length of surfaces 42 of stops 36. By example, in the preferred embodiment relieved surfaces 44 are provided on second opposed surface 32 and slot 22 is generally T shaped. Relieved surfaces 44 are aligned with upper surfaces 56. The central portion of upper wall 58 is recessed by an amount that is sufficient to allow the passage there through of the portion of second opposed surface 32 near distal end 38 which is not relieved. Consequently, there are various possible shapes for second opposed surface 32 adjacent distal end 38. There are an equal number of matching shapes for upper wall 58 of slot 22.

By so shaping tongue 20 and slot 22, end units 12 may be joined together once they have been manufactured without any additional processing. FIGS. 4*a*, 4*b* and 4*c* best show the joining of end units 12. Tongue 20 is advanced into slot 22 until surfaces 40 of stops 36 contact edge 51 of surface 50 (FIG. 4*a*). Continued pressure on tongue 20 causes tongue 20 to deflect upwards as surfaces 40 of stops 36 slide up edge 51 of surface 50. This results in surfaces 44 contacting upper surface 56 (FIG. 4*b*). In the preferred embodiment, the support panels are made from plastic. This enables surface 50 to be deformed downwards by stops 36, easing the passage of tongue 20 through slot 22. As stops 36 approach the end of surface 50 near support panel 14, the part of opposed surface 32 between surfaces 44 enters the centrally located recessed portion of upper surface 58 of slot 22. As stops 36 exit slot 22, upper surface 56 of slot 22 contacts inclined surfaces 46 of surfaces 44. Continued pressure on tongue 20 causes inclined surfaces 46 to slide down upper surface 56. Thus, tongue 20 deflects downwards as stops 36 pass through slot 22 (FIG. 4*c*). Once stops 36 have passed through slot 22, guide channels 54 force transverse ridges 34 of first opposed surface 30 of tongue 20 to interlock with transverse ridges 52 of surface 50 of slot 22.

Storage area 24 may be increased or decreased in size by support panels 14 being manually pulled apart or pushed together respectively. Such manual operation causes transverse ridges 34 to ride up and over transverse ridges 52. Since the transverse ridges 34 extend over a substantial portion of surface 30 of tongue 20, there are numerous positions in which the holder 10 may be locked. In addition, since a plurality of transverse ridges are located on both first opposed surface 30 of tongue 20 and surface 50 of slot 22, many transverse ridges will interlock at any of these numerous positions. However, because of the interlocking of the transverse ridges, the lateral force exerted by the napkins against support panels 14 is insufficient to cause movement of support panels 14 relative to each other.

To take the holder 10 apart, end units 12 are pulled apart until surfaces 42 of stops 36 are in contact with outside edge 60. Since surfaces 42 depends substantially perpendicularly from first opposed surface 30 of tongue 20, a relatively large force must be applied to cause surfaces 42 to ride up outside edge 60 so as to allow tongue 20 to be pulled out of slot 22. Consequently, the holder 10 can not be pulled apart accidentally while the size of storage area 24 is being adjusted.

As shown in FIG. 6, in the preferred embodiment, each support panel 14 is formed at an acute angle to base 12. When napkins are placed in storage area 24 and end units 12 are closed so that inner surfaces 26 of support panels 14 contact the napkins, the napkins exert an outward latteral force against each support panel 14 which causes each support panel 14 to deflect to form a larger acute angle with base 12. This enchances the contact between guide channels 54 and tongue 20 and increases the interlocking between transverse ridges 52 of slot 22 and transverse ridges 34 of tongue 20.

In the preferred embodiment, the end units 12 are identical. This decreases the cost of production since it allows both of the end units 12 for one holder to be formed from the same mould. It is possible in one embodiment of the invention to make a holder in which the base of one end unit comprises a tongue and the base of the other end unit comprises a slot. However, such a holder would not be as stable as the holder of the preferred embodiment.

We claim:

1. An adjustable holder having first and second opposed slideable end units, detent means and stop means, each of said end units having a support panel and a longitudinally extending base wherein:

(a) the base of said first end unit comprises a tongue having proximal and distal ends, said tongue having first and second substantially planar opposed surfaces;

(b) the base of said second end unit comprises a complementary slot having a longitudinally extending surface;

(c) said first opposed surface and said longitudinally extending surface comprising said detent means to prevent movement of one of said end units relative to the other of said end units; and (d) said distal end of said tongue and said slot comprise said stop means and are dimensioned so that in at least one direction, the distal end of said tongue is larger than said slot such that when said tongue is inserted in said slot, an increased amount of external force must be applied to said adjustable holder to withdraw said tongue from said slot than to adjust the distance between the end units.

2. An adjustable holder as claimed in claim 1 wherein said first opposed surface further comprises a plurality of transverse ridges and said longitudinally extending surface further comprises a plurality of transverse ridges, said transverse ridges comprising said detent means.

3. An adjustable holder as claimed in claim 2 wherein said slot and said tongue are dimensioned so as to maintain contact between said first opposed surface and said longitudinally extending surface.

4. An adjustable holder as claimed in claim 3 wherein said transverse ridges extend over a substantial portion of the longitudinal length of said first opposed surface.

5. An adjustable holder as claimed in claim 4 wherein said plurality of transverse ridges comprise a plurality of serrations.

6. An adjustable holder as claimed in claim 5 wherein the base of each end unit comprises a tongue and a slot.

7. An adjustable holder as claimed in claim 1 wherein said distal end of said tongue and said slot are dimensioned so that there is an interference fit between said distal end and said slot so as to form said stop means.

8. An adjustable holder as claimed in claim 7 wherein said second opposed surface adjacent said distal end of said tongue further comprises two relieved surfaces, one of said relieved surfaces being disposed at each edge of said tongue, said relieved surfaces commencing at the distal end of said tongue and extending in said longitudinal direction towards the proximal end of said tongue, the ends of said relieved surfaces that are closest to said proximal end of said tongue having surfaces that are inclined so as to meet said second opposed surface.

9. An adjustable holder as claimed in claim 8 wherein said slot further comprises upper, lower and side walls which describe a generally T shaped opening, said longitudinally extending surface comprising said lower wall, the distance from any point on said longitudinally extending surface at said support panel perpendicular to any point on said upper wall being at least equal to the perpendicular distance between said first and second opposed surfaces near the proximal end of said tongue.

10. An adjustable holder as claimed in claim 9 wherein said upper wall has a central portion, said central portion being recessed by an amount that is substantially equal to the perpendicular distance between said relieved surfaces and the plane of said second opposed surface.

11. An adjustable holder as claimed in claim 10 wherein said first opposed surface of said tongue further comprises at least one stop near said distal end of said tongue, said stop having an inclined surface which extends to meet said second opposed surface, the included angle between said inclined surface and said second opposed surface being obtuse.

12. An adjustable holder having first and second opposed slideable end units, detent means and stop means, each of said end units having a support panel and a longitudinally extending base wherein:

(a) the base of said first end unit comprises a tongue having proximal and distal ends and two longitudinal edges there-between, said tongue having first and second substantially planar opposed surfaces, said first opposed surface having a plurality of transverse ridges extending over a substantial portion of the longitudinal length of said first opposed surface and at least one stop near said distal end, said second opposed surface having two relieved surfaces located adjacent said distal end, one of said relieved surfaces being disposed at each edge of said tongue, said relieved surfaces commencing at the distal end of said tongue and extending in said longitudinal direction towards the proximal end of said tongue, and (b) the base of said second end unit comprises a generally T shaped slot, said slot having a longitudinally extending surface, said longitudinally extending surface having a plurality of transverse ridges which interact with said transverse ridges of said first opposed surface, said tongue and said slot being dimensioned so as to maintain contact between said first opposed surface and said longitudinally extending surface so as to comprise said detent means, and said releived surfaces, slot and stop comprise said stop means.

13. An adjustable holder as claimed in claims 1, 7 or 12 having an included angle between said support panel and said base said included angle being acute.

14. An adjustable holder as claimed in claim 12 wherein the base of each end unit comprises a tongue and a slot.

15. An adjustable holder as claimed in claims 6 or 14 wherein said end units are identical.

16. An adjustable holder as claimed in claims 1, 7 or 12 wherein said end units are integrally formed from plastic.

* * * * *